United States Patent [19]

Clark

[11] 3,991,819

[45] Nov. 16, 1976

[54] AIR CONDITIONING DEVICE

[75] Inventor: Ronald John Clark, Sidmouth, England

[73] Assignee: Sealed Motor Construction Co. Ltd., England

[22] Filed: Apr. 5, 1974

[21] Appl. No.: 458,458

[30] Foreign Application Priority Data

Apr. 11, 1973 United Kingdom ..... 17513/73

[52] U.S. Cl. ..... 165/29; 165/59; 165/62; 62/525; 417/353

[51] Int. Cl.[2] ..... F25B 29/00

[58] Field of Search ..... 165/29, 30, 48, 97, 165/62; 62/325; 310/268; 417/353

[56] References Cited

UNITED STATES PATENTS

| | | | |
|---|---|---|---|
| 547,069 | 10/1895 | Görges | 310/268 |
| 2,466,383 | 4/1949 | Cody | 62/325 |
| 2,878,657 | 3/1959 | Atchison | 62/325 |
| 3,171,356 | 3/1965 | Pensabene | 310/268 |
| 3,223,867 | 12/1965 | Shapiro | 310/166 |
| 3,225,235 | 12/1965 | Lee | 310/268 |
| 3,466,479 | 9/1969 | Jarret et al. | 310/268 X |
| 3,517,527 | 6/1970 | Bouchat | 62/325 |

FOREIGN PATENTS OR APPLICATIONS

| | | | |
|---|---|---|---|
| 103,682 | 2/1938 | Australia | 62/325 |

*Primary Examiner*—Albert W. Davis, Jr.
*Assistant Examiner*—James D. Liles
*Attorney, Agent, or Firm*—Larson, Taylor and Hinds

[57] ABSTRACT

A ventilating unit has separate passages connecting internal and external environments, and a reversible heat pump with evaporator in one passage and condenser in the other passage. Separate reversible axial flow fans are located in the two passages. Two ventilating modes are provided, in each of which the fans are moving air in opposite directions through the passages. When the internal environment is relatively warm, the incoming air passes over the evaporator and the outgoing air over the condenser, and vice versa when the internal environment is relatively cool. Special fan design facilitates direction reversal, and also variable speed operation. The unit also has an additional inlet with a heater, and control means are adapted to provide a recirculation mode in which the recirculated air is heated thereby.

9 Claims, 9 Drawing Figures

AIR CONDITIONING DEVICE

FIELD OF THE INVENTION

This invention relates to devices for ventilating buildings, and is especially applicable to ventilating centrally heated or air-conditioned environments.

DESCRIPTION OF THE PRIOR ART

Although central heating for buildings has become generally accepted practice, and even full air-conditioning is now widely used, in order to minimise the expenditure of increasingly costly energy a good deal of attention has been paid to minimising heat transfer between the conditioned environment and the external environment. Principally, this involves providing a high degree of insulation in the building, and eliminating draughts, and other unnecessary movement of air. However, this results in an almost hermetically sealed environment, which quickly becomes stuffy and unpleasant after a short period of occupation. The usual method of introducing fresh air from the external environment, whether by convection of forced air flow, obviously leads to the problem of energy loss.

It has been proposed in U.S. Pat. No. 2401560 to provide an air-conditioning unit, using a reversible heat pump with a separate evaporator and condensor, and moving air between the internal and external environments in one direction over the evaporator and in the other direction over the condensor. The object of this is to try and combine air conditioning with ventilating in the same unit, and effect a transfer of heat between the incoming and outgoing air streams, thus reducing energy losses between the two environments as a result of the transfer of air. However, this proposed apparatus involves a number of drawbacks. Firstly, it uses cumbersome dampers to change the direction of air flow and to vary the proportions of transferred and recirculated air. This makes it difficult to achieve a satisfactory balance of conditions, and relies on the skill of the user, and unnecessary heat losses are likely to occur as a result of this. Also, the heat pump system is the same one as is used for effecting the basic air-conditioning of the internal environment. This makes it a big unit, and makes it difficult to achieve a satisfactory and economic control of ventilation independent of the air flow requirements of the air-conditioner. Although there is provision for reducing the proportion of incoming air by introducing a proportion of recirculated air, the total air flow is constant, and must all be exhausted to the external environment, with a result that one side of the heat exchanger has to deal with heat transfer to or from a full flow of conditioned air, while the other side of the unit is faced with only a small heat transfer to or from the relatively lower intake of external air. Under such conditions, efficient use of energy is scarcely possible. In addition this prior unit must be mounted in a window or thin partition, if very complicated damper arrangements are not to be required.

SUMMARY OF THE INVENTION

The present invention avoids the foregoing difficulties by separating the ventilating activity from the room heating or air-conditioning activity. Moreover, the present invention achieves heat transfer in the ventilating mode in a balanced and easily controlled manner, without the use of dampers.

According to the present invention there is provided a ventilating unit comprising a housing containing a reversible heat pump having an evaporator and a condenser, separate air passages adapted to entrain air around the condensor and evaporator respectively between internal and external environments, separate reversible fans in the passages for moving the air independently in either direction through the ducts, and control means adapted to provide at least two modes of operation, a first mode in which the fans act to move air between the two environments in one direction around the evaporator and in the opposite direction around the condensor, and a second mode in which the fans act to move air between the two environments in said one direction around the condensor and in said opposite direction around the evaporator.

A recirculating mode may be provided by a damper in the housing movable to shut off the passages from the external environment and to provide for recirculation of the internal air by the fans, the control means preferably linking movement of the damper with the heat pump unit so as to shut off the heat pump when the recirculation mode is selected. The housing may also be provided with a heat exchange unit, preferably a heater, arranged to change the temperature of the air in the recirculating mode. The control means may be adapted to operate both fans in the same direction in the recirculating mode. The control means may also provide variable speed control, e.g. twospeed control, for the fans.

BRIEF DESCRIPTION OF THE DRAWINGS

In order that the invention may be more clearly understood, one embodiment will now be described with reference to the accompanying drawings, wherein.

Figure 3:
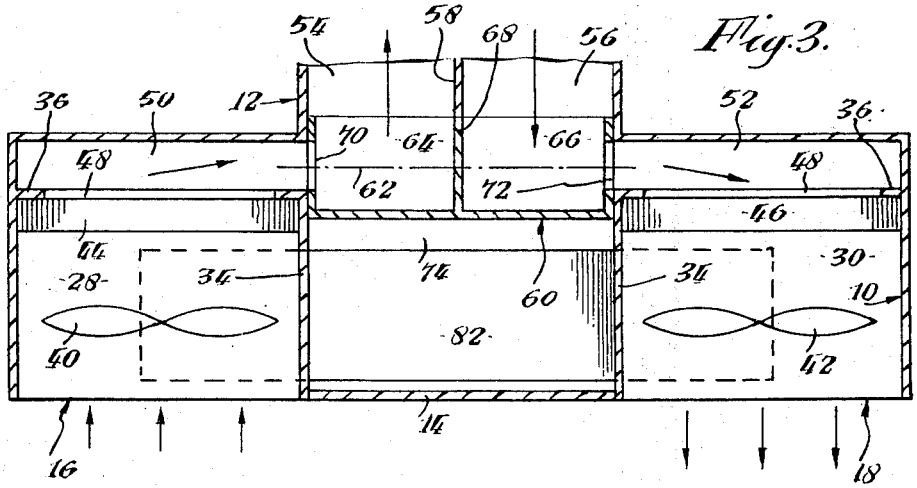
FIGS. 3, 4 and 5 show diagrammatic cross-sectional plan views of the unit in three different modes of operation.
Figure 4:
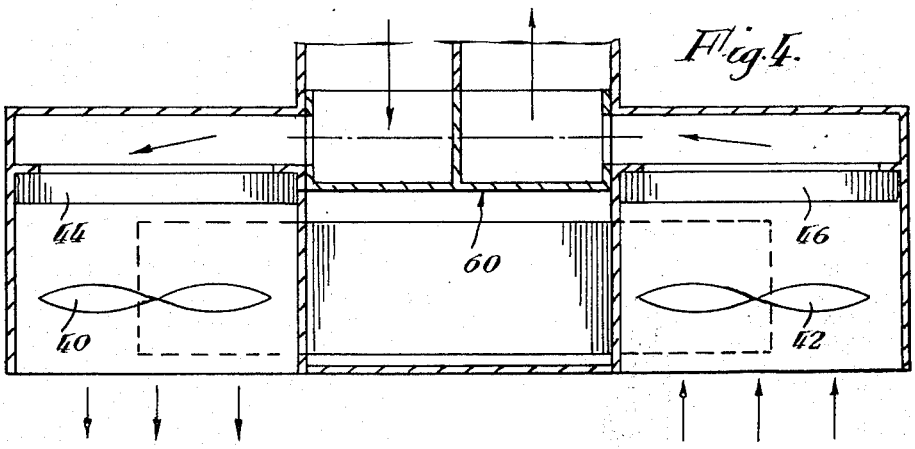
Figure 5:
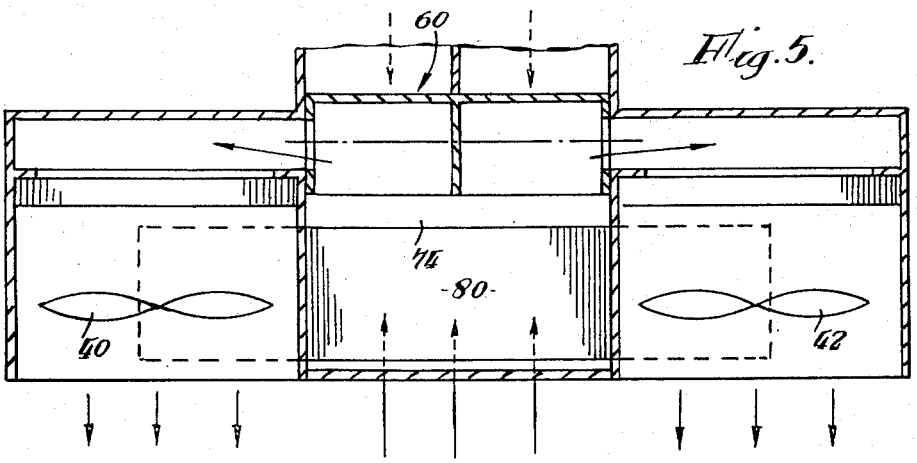

Referring to the drawings; the ventilator unit comprises a rectangular housing 10 having a rearwardly extending duct 12 for passing through the wall of the room being ventilated and communicating with the external environment. The front of the housing has a central panel 14 flanked by two openings 16, 18 respectively. The openings are covered by respective grilles 22 and 24 respectively, and the panel 14 is partially covered by a decorative grille 20. Behind the grilles 22 and 24 there is a layer 26 of a suitable filter material. The openings 16, 18 lead to separate front compartments 28, 30 respectively, each of which is defined by a floor 32, vertical partition 34 and back panel 36. Within each compartment 28, 30 there is a transverse panel 38 having a large circular aperture in which is mounted a reversible electric fan, designated 40 in compartment 28 and 42 in compartment 30. Behind the fans 40, 42, evaporator and condensor coils 44, 46 are respectively mounted to the back panels 36 of the compartments. The back panels have openings 48, covered by a filter material 49, to allow air to pass through the evaporator and condensor between the front compartments 28, 30 and respective rear compartments 50, 52. The duct 12 is divided into two separate passages 54, 56 by a central partition 58, and at the inner end of the duct, in the back of the housing 10, there is a cylindrical valve 60. This valve is rotatably mounted within the housing about a horizontal axis 62. The cylinder is open along one side and closed along the other, and is divided into two compartments 64, 66 by means of a central partition 68, which mates with the partition 58 in the duct 12. The ends of the cylinder are provided with openings 70, 72, so that the compartments 64, 66 are at all times in communication with the rear compartments 50, 52 respectively of the housing. The cylindrical valve is located at the back of a central compartment 74 between the two rear compartments 50, 52. Thus, by rotating the cylindrical valve 60, the rear compartments 50, 52 can be brought into communication alternatively with the respective passages 54, 56 of the duct 12 (as shown in FIGS. 3 and 4) or jointly with the central compartment 74 of the housing (as shown in FIG. 5). The central compartment 74 occupies only the lower part of the central region behind the panel 14, the upper part being separated therefrom by a floor panel 76 which supports an electrically driven heat pump 78 connected to the evaporator and condensor. However, the central compartment 74 at its lower end extends laterally under the compartments 28, 30 for the full width of the unit. In this lower part there is mounted an elongate heat exchange unit 80, of conventional finned construction, which rests on the floor 82 of the housing over an openings 84 which communicates with the room environment and is covered by filter material 85. The heat exchanger 80 is intended primarily for supplying heat to the room environment in one operating mode of the unit, as will be described later. It is thus connected to a suitable heat supply source, such as a forced circulation hot water central heating system, but could instead be an electrically heated element. The floor 32 below the evaporator 44 is depressed to form a trough to collect condensate, and a conduit 85 conducts the condensate to the other end of the housing where it is delivered to a boiler 86 in the rear compartment 52 behind the condensor. The boiler chamber contains a float which operates a mercury switch when the condensate level reaches a predetermined height, which switches on an electric heating element in the liquid. In this way, the condensate can be boiled away into the hot air stream around the condensor.

Figure 7:
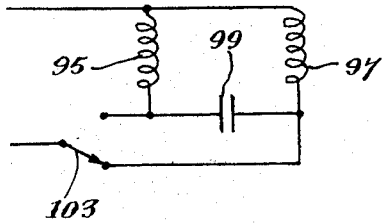
FIGS. 7 and 8 show circuit diagrams for the fanreversing switch operations.
Figure 8:
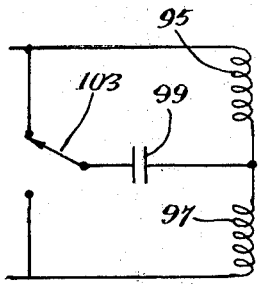
Figure 9:
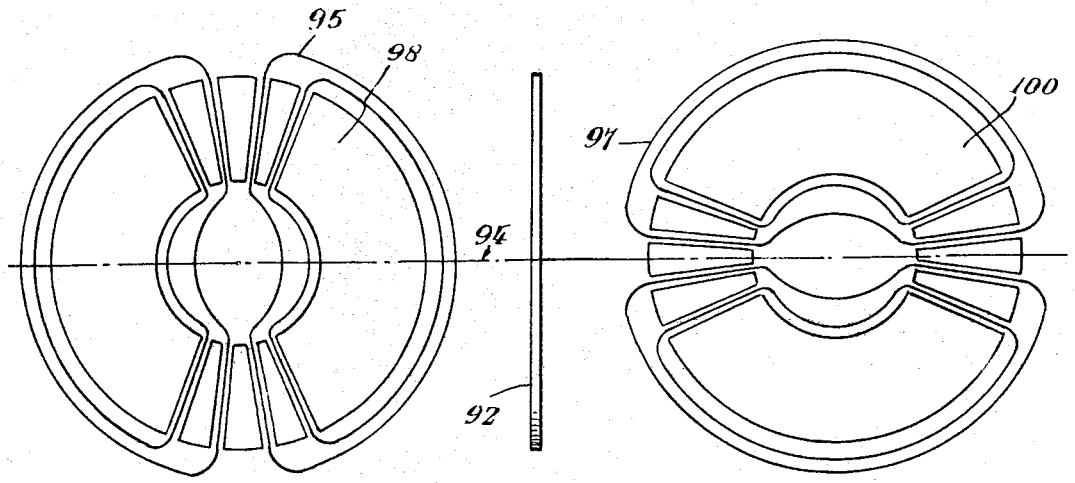
FIG. 9 shows diagrammatically the stator arrangement of a fan, the two stators being shown in face view and the rotor disc in side view.

The fans 40, 42 require some special description, since they are an important factor in the successful operation of the present invention. They are identical units, and their principle of construction and operation is as described in our co-pending British Pat. No. 15778/72 (U.S. Pat. No. 347450 filed Mar. 30, 1973). An indication of this construction is shown in cross-section in FIG. 2. The fan vanes 88 are carried on an annular support 90 within which is located a copper disc rotor 92, mounted to a spindle 94. The spindle is journalled to the fixed central motor housing 96 of the fan. The stator is in two parts 98, 100, with windings 95, 97 respectively, and located on opposite sides of the rotor disc 92. The motor is of the two-phase type, each stator part having one half of the two-phase winding. In this particular instance it is a permanent split capacitor motor running from a single phase supply. The stator parts are disposed so that the poles of one part are intermediate the poles of the opposite part, as shown in FIG. 9. The rotating component of this fan is of very light construction; the vanes 88 and annulus 90 conveniently being formed from plastic material, and the disc 92 comprising a thin sheet of copper or aluminium, with no added iron. It thus has a low inertia, so that on reversing the stator field, the fan will stop and start rotating in the opposite direction within a matter of two or three seconds. Since the disc rotor is small and light, it carries relatively little current, so that the current generating effect which arises when the stator field is reversed and before the rotor stops, is relatively small and will not damage the motor. Moreover, being a uniform disc, there is no motor noise arising from bar frequencies, and there are no undue axial forces on the rotor which would arise from magnetic attraction between rotor and stator if the rotor were to contain iron. FIGS. 7 and 8 show how the stator field can be reversed. The two stator windings 98, 100 can either be wound in parallel, as in FIG. 7, or in series, as in FIG. 8. The phase shift capacitor 99 is connected with one or other of the windings, in the manner shown, by means of switch 103. This simple switching of the capacitor reverses the direction of rotation of the stator field. Also, the stator windings have relatively high resistance e.g. about 180 ohm each, so that the rotor only absorbs a relatively small fraction of the stator power, and can more easily follow voltage variations in the stator windings used to control the fan speed. The voltage charge could be by means of a variable resistance in the stator winding circuit, or by thyristor controlled chopped supply to the stator winding not having the capacitor.

In the first mode of operation, shown in FIG. 3, the two fans 40, 42 are running in opposite directions; the fan 42 drawing fresh air from the external environment over the hot condensor coil 46 and blowing it into the room, while the fan 40 draws stale air from the room over the cold evaporator coil 44 and blows it out into the external environment. This mode of operation is typically used in winter, when the internal environment is warmer than the external environment. Thus, the evaporator removes heat from the out-going air and transfers it via the condensor to the incoming air.

The second mode of operation, shown in FIG. 4, is identical to that shown in FIG. 3, except that the direction of rotation of the two fans is reversed. In this mode, therefore, the fresh air is drawn in by the fan 40 over the cold evaporator coil 44, while the stale air is removed by the fan 42 over the hot condensor coil 46. This arrangement is typically used in summer when the internal environment is cooler than the external environment. It is particularly useful in rooms which have full air-conditioning in summer, since it is important not to waste the energy used to cool the room, as would happen with conventional ventilation means.

Figure 2:
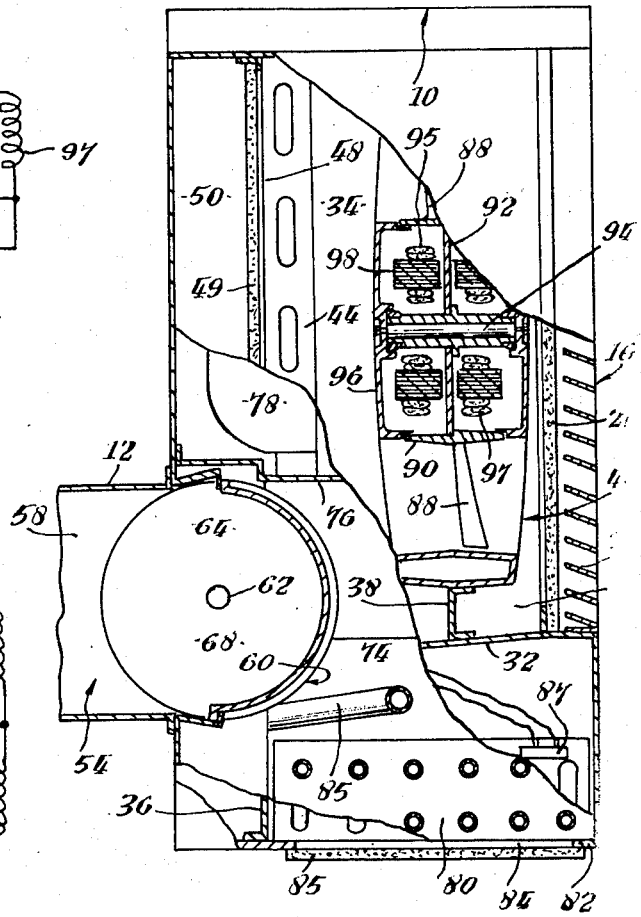
FIG. 2 shows a partially cut-away side view of the unit.

In a third mode, shown in FIG. 5, the valve 60 is rotated so that it opens into the central compartment 74, and the two fans are arranged to run in the same direction drawing air from the central compartment 74 and blowing it out into the room. In this mode of operation, the heat pump unit is switched off, so that the condensor and evaporator are inoperative. However, the room air, under the influence of the fans, enters the housing through the bottom opening 84 and through the heat exchanger 80. Thus, provided that heat is supplied to the heat exchanger 82, the unit in this third mode of operation acts as a room heater, or auxiliary room heater, with the room air being recirculated over the heat exchanger. FIG. 2 shows a thermostat 87 on the heat exchanger 82, which is wired into the control circuit for the unit so as to switch off the fans if the heat exchanger cools down, for example at night when the central heating may be automatically switched off.

Figure 1:
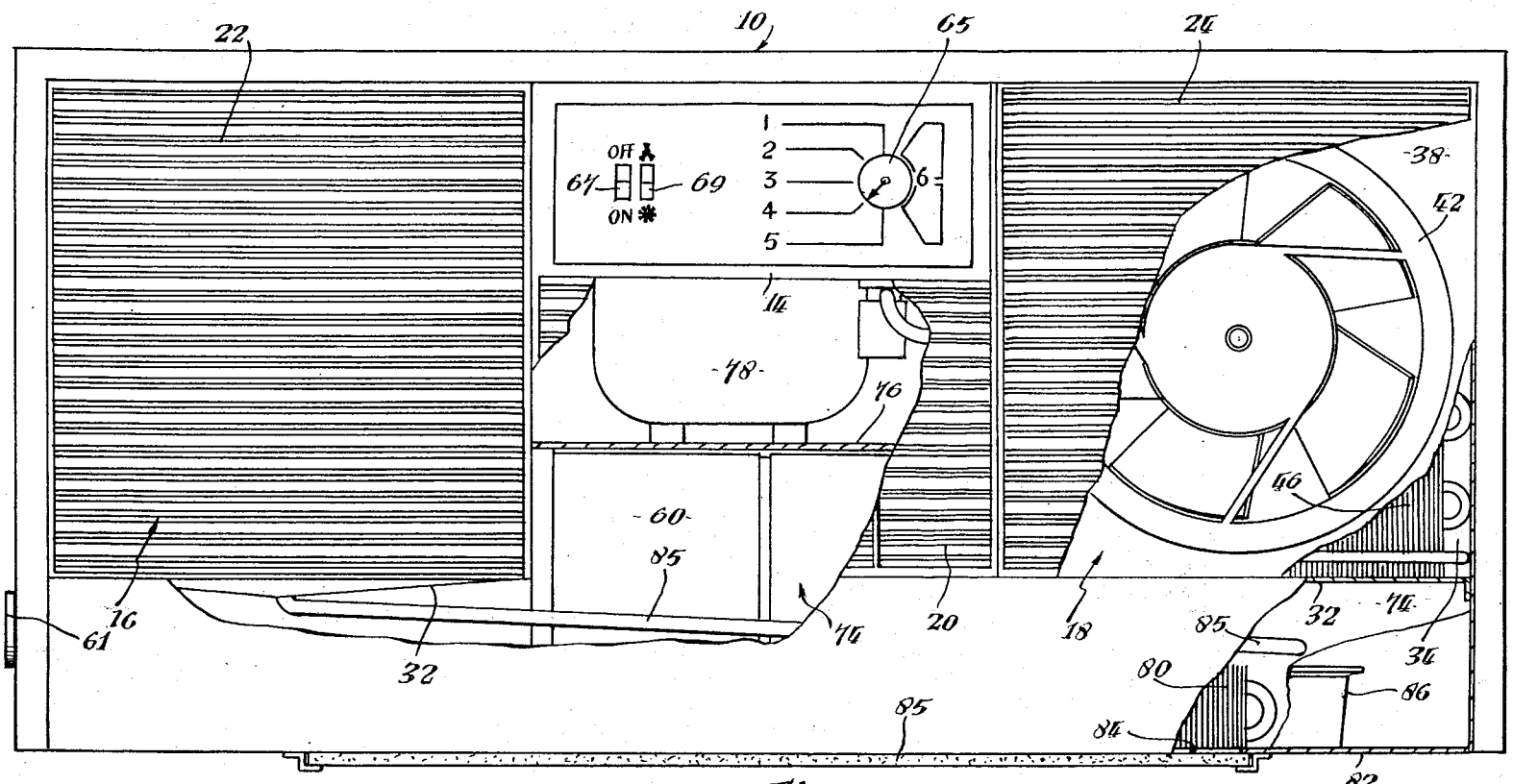
FIG. 1 shows a partially cut-away front view of a ventilating unit.
Figure 6:
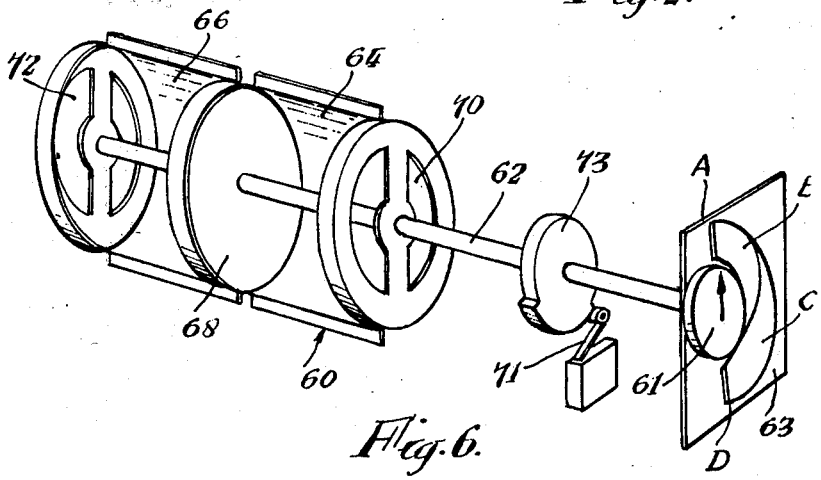
FIG. 6 shows diagrammatically the control for the valve.

As a modification of this third mode of operation, it is possible to select an intermediate position of the valve 60, so that a certain amount of fresh air is inducted into the recirculating air, and the amount of recirculating air passing over the heater is reduced. FIG. 6 shows how the rotation of the valve 60 is effected by means of an external knob 61 at the side of the housing. A fixed plate 63 under the knob indicates the position of the valve between fully open fresh air (position A) and fully open to recirculation (position D). In between, tapering zones B and C indicate different intermediate positions of the valve; zone B predominantly fresh air, and zone C predominantly recirculation. Further controls are presented on panel 14, as shown in FIG. 1. A knob 65 can be moved to any positions 1 – 6, and cams on the knob spindle operate microswitches controlling the fans and the heat pump. In postions 1 – 3 the heat pump is off. In position 1 both fans blow air into the room. In position 2 both fans extract air from the room. In position 3, one fan blows and the other extracts. The knob 61 can be in any of zones A – D in these positions, and will determine the extent to which the air moves between the room and external environments or is recirculated. In positions 4 and 5 the heat pump is switched on, so that these positions provide the first and second modes respectively, indicated in FIGS. 3 and 4. For these modes the knob 61 is set to position A. Position 6 of knob 65 gives the central heating mode of FIG. 5. The knob 61 is set to zone D if recirculation only is required, or zone C if some degree of fresh air induction is required. The heat pump is of course inactive in this setting of knob 65. A microswitch 71 actuated by a cam 73 on the valve spindle, as shown in FIG. 6, is connected to the heat pump circuit to ensure that the heat pump is only switched on in zone A. Also shown in FIG. 2 are an on/off switch 67, and a two-speed control switch 69 for the fans, which alters the fan speed, in the manner indicated above, to give, for example, a slower speed of about 65% full speed.

Air humidification may be achieved by means of a water reservoir in the housing, manually or automatically filled, and arranged to be dispersed to the incoming air stream, for example by means of a series of wicks which are arranged in the moving air stream so that water is evaporated and taken up by the air. It will be observed, however, that in the unit described, the condesate from the evaporator is boiled and returned to the hot air stream. In this way, changes of existing humidity conditions are minimised; in the first mode of operation the incoming warmed air stream is humidifed, while in the second mode of operation the incoming cooled air stream is dried.

It will be seen that the present invention is distinguished from a conventional air-conditioning device by a number of important factors. Principal among these is the use of reversible fans, which quickly and simply change the mode of operation without the need for delicate adjustment of dampers. Moreover, this electric fan readily lends itself to thermostatic and other forms of automatic control, and its speed can be varied widely. It will also be noticed that the two halves of the ventilation unit are entirely symmetrical so that, together with the identical fans, a completely balanced system is obtained during the ventilating modes. This unit is not an air-conditioning plant in the usual meaning of the term, but rather a compensating unit intended to provide ventilation of any internal environment, whether heated, cooled or untreated, without making any substantial changes or demands on the room environment. The unit can be mounted on any wall, or partition surface, whether internal or external, since the rear ducting can be extended as desired.

The fans have been shown mounted in front of the evaporator and condensor. This is advantageous because the evaporator and condensor fins act to straighten the airflow from the fans, so that the flow characteristics in the narrow rear passages of the unit are unaffected by the direction of rotation of the fans. Reversing the relative positions of the fans and evaporator/condensor would give more attenuation of the fan noise, but would give an unbalanced flow pattern when the fans are operating in opposite directions. In any case, the present fans have extremely low noise, as indicated.

I claim:

1. A ventilating unit comprising a housing containing a reversible heat pump having an evaporator and a condenser, separate air passages for entraining air around the condensor and evaporator respectively between internal and external environments, separate reversible fans in the passage for moving the air independently in either direction through the passages, and control means providing at least three modes of operation, a first mode in which the fans act to move air between the two environments in one direction around the evaporator and in the opposite direction around the condenser, and a second mode in which the fans act to move between the two environments in said one direction around the condenser and in said opposite direction around the evaporator, the housing having an additional inlet for air from the internal environment, and a valve movable to connect the additional inlet with the fans so as to provide a recirculation mode of operation of the unit, said control means including means for switching the heat pump off during the recirculation mode of operation, a heater being provided in the housing, arranged for heating air entering the housing through said additional inlet, the control means being arranged so that both fans operate in the same direction when the heater is in operation.

2. A ventilating unit comprising a housing, two similar front compartments within the housing, each having an opening at the front to the internal environment to be ventilated, and each having an opening at the rear to respective rear compartments which are also similar to each other, a reversible axial flow fan mounted in each front compartment for moving air between the front and rear openings, a reversible heat pump mounted within the housing comprising a compressor connected to an evaporator and a condenser mounted one across each of the rear openings of the front compartments, a duct projecting from the rear of the housing comprising two separate but similar parallel passages for connecting to the external environment, an additional air inlet at the bottom of the housing for air from the internal environment, a heater device arranged across the additional opening for heating air entering therethrough, a valve at the inner end of said duct and between said rear compartments movable between a first position connecting the rear compartments with respective ones of said duct passages and a second position connecting the rear compartments jointly with said additional inlet, and control means including means for enabling the selection of alternative ventilating modes in which the valve is in said first position, the heat pump is operating, and the fans are moving air in one direction over the evaporator and in the opposite direction over the condenser, and a heating mode in which the valve is in said second position, the heat pump is inoperative, and the fans are moving air in a common direction through said additional inlet, over the heater and recirculating it to the internal environment through said front openings, the fans being of similar construction and design, and comprise a rotor in the form of a thin highly conductive non-magnetic disc located between two flat-face stators, each stator having one phase of a two-phase winding, and arranged so that the poles of one stator are intermediate those of the opposite stator, the fan vanes being carried directly by the rotor disc, a phase shift capacitor for the windings being connectable by means of a switch with one or other of the windings for reversing the direction of rotation, the control means further including means for providing at least two selectable fan speeds in the ventilating modes.

3. A ventilating unit comprising a housing containing a reversible heat pump having an evaporator and a condensor, separate air passages for entraining air around the condensor and evaporator respectively between internal and external environments, separate reversible fans in the passages for moving the air independently in either direction through the passages, and control means, including means for reversing the direction of rotation of said fans, for providing at least three modes of operation, a first mode in which the fans act to move air between two environments in one direction around the evaporator and in the opposite direction around the condenser, and a second mode in which the fans act to move air between the two environments in said one direction around the condenser and in said opposite direction around the evaporator, the housing having an additional opening for air from the internal environment, and a valve movable to connect the additional opening with fans so as to provide a recirculation mode of operation of the unit, and a heater arranged so as to be operable to heat air passing through said additional opening said control means including means for switching the heat pump off during the recirculation mode of operation.

4. A ventilating unit comprising a housing containing a reversible heat pump having an evaporator and a condenser, separate air passages for entraining air around the condenser and evaporator respectively between internal and external environments, separate reversible fans in the passages for moving the air independently in either direction through the passages, and control means providing at least two modes of operation, a first mode in which the fans act to move air between the two environments in one direction around the evaporator and in the opposite direction around the condenser, and a second mode in which the fans act to move air between the two environments in said one direction around the condenser and in said opposite direction around the evaporator, the fans being of similar construction and design, and comprising a rotor in the form of a thin highly conductive disc located between two flat-face stators, each stator having one phase of a two-phase winding, and said stators being arranged so that the poles of one stator are intermediate those of the opposite stator, the fan vanes being carried directly by the rotor disc, switch means for selectably connecting a phase shift capacitor for the windings with one or other of the windings for reversing the direction of rotation, the control means being further including means for providing at least two selectable fan speeds in the ventilating modes.

5. A modular ventilating unit for mounting to the internal wall of a room to be ventilated, the unit comprising a generally rectangular housing, two similar compartments within the housing, each having in the front of the housing an opening to the room, and each having in the rear of the compartment an opening to a respective rear passage, the rear passages also being similar to each other and extending through a duct projecting from the rear of the housing for passage through the wall of the room to an external environment, a reversible axial flow fan mounted in each said compartment for moving air between said openings, the fans being located within said compartments with their axes or rotation at right angles to rear of the housing, a reversible heat pump mounted within the housing comprising a compressor connected to an evaporator and a condensor, said evaporator and condenser being mounted one across each of the compartments to the rear of the fans, and in a plane parallel to that of the fans, the rearwardly projecting duct being arranged so that the rear air passages are offset from lines of air flow through said compartments between the openings therein, and control means, including means for reversing the direction of rotation of the fans, for providing the selection of alternative ventilating modes in which the fans move air in one direction over the evaporator and in the opposite direction over the condenser.

6. A modular ventilating unit according to claim 5 wherein the fans comprise a rotor in the form of a thin highly conductive disc located between two annular flat-face stator packs, the fan vanes being carried directly at the periphery of the rotor disc.

7. A modular ventilating unit for mounting to the internal wall of a room to be ventilated, the unit comprising a generally rectangular housing, two similar compartments within the housing, each having an opening to the room, and each having an opening to respective rear passages, which are also similar to each other and extend through a duct projecting from the rear of the housing for passing through the wall of the rooms to an external environment, a reversible axial flow fan mounted in each said compartment for moving air between said openings, a reversible heat pump mounted within the housing comprising a compressor connected to an evaporator and a condenser, said evaporator and condenser being mounted one across each of the compartments to the rear of the fans, the rearwardly projecting duct being arranged so that the rear air passages are offset from the line of air flow through said compartments between the openings therein, and control means for providing for the selection of alternative ventilating modes in which the fans move air in one direction over the evaporator and in the opposite direction over the condenser, an additional air inlet in the housing for air from the room, a heater device arranged across the additional opening for heating air passing therethrough, a valve in said rear passages at the inner end of the duct and movable between a first position wherein said valve connects the rear compartments with respective ones of the duct passages and a second position wherein said valve connects the compartments jointly with said additional inlet, the control means including means providing selection of alternative ventilating modes in which the valve is in said first position, the heat pump is operating, and the fans are moving air in one direction over the evaporator and in the opposite direction over the condenser, and a heating mode in wich the valve is in said second position, the heat pump is inoperative, and the fans are moving air in a common direction through said additional inlet, over the heater and recirculating the air to the room environment.

8. A modular ventilating unit for mounting to the internal wall of a room to be ventilated, the unit comprising a housing containing a reversible heat pump comprising a centrally mounted compressor, an evaporator and a condenser, two separate air passages for entraining air around the condenser and evaporator respectively between the room environment and an external environment, separate reversible axial flow fans in the passages for moving the air independently in either direction through the passages, and control means for providing at least two modes of operation, a first mode in which the fans act to move air between the two environments in one direction around the evaporator, and in the opposite direction around the condenser, and a second mode in which the fans act to move air between the two environments in said one direction around the condenser and in said opposite direction around the evaporator, the two air passages between the room and external environments being substantially identical in form, so as to present essentially similar air flow characteristics in the first and second modes of operation, said passages comprising front and rear parts, the front parts lying within the housing on either side of the compressor and containing respectively the evaporator and condenser and respective fans, and the rear part extending through a short divided duct projecting centrally from the rear of the housing for passing through the wall of the room to the external environment, the housing and duct being arranged so that the front and rear parts of the passages are out of alignment, the fans being arranged with their axes of rotation at right angles to the rear of the housing, the evaporator and condenser being each arranged across its respective passage behind its respective fan and in a vertical plane parallel to the plane of the fan, and said control means including means for reversing the direction of rotation of said fans.

9. A modular ventilating unit according to claim 8 wherein the front parts of the passages are provided by two similar compartments in the housing, each having an opening to the room environment and a second opening leading to the external environment, each compartment containing a respective one of the fans and a respective one of the evaporator and condenser, the evaporator and condenser being arranged on the side of their respective fans remote from the first openings so as to attenuate the air flow directed by the fans through the second openings to the rear parts of the passages and substantially eliminate the rotational effect from the fans.

* * * * *